US008291546B2

(12) United States Patent
Louis et al.

(10) Patent No.: US 8,291,546 B2
(45) Date of Patent: Oct. 23, 2012

(54) RECOVERY TANK FOR AN EXTRACTOR CLEANING MACHINE

(75) Inventors: Jeffrey S. Louis, Akron, OH (US); David Chaney, Northfield, OH (US); Harald Krondorfer, Aurora, OH (US); Ronald Rich, Burton, OH (US); Robert A. Salo, Mentor, OH (US); Steven J. Paliobeis, Mentor, OH (US); Patrick J. Quinn, North Canton, OH (US); Kevin Vail, North Royalton, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 13/224,040

(22) Filed: Sep. 1, 2011

(65) Prior Publication Data

US 2012/0131760 A1 May 31, 2012

Related U.S. Application Data

(60) Provisional application No. 61/379,206, filed on Sep. 1, 2010.

(51) Int. Cl.
*A47L 7/00* (2006.01)

(52) U.S. Cl. ..... 15/410; 15/327.6; 15/320

(58) Field of Classification Search ..... 15/320, 15/327.2, 327.6, 410; *A47L 7/00*
See application file for complete search history.

(56) References Cited

U.S. PATENT DOCUMENTS

| | | | |
|---|---|---|---|
| 5,406,673 | A | 4/1995 | Bradd et al. |
| 5,655,254 | A | 8/1997 | Bores et al. |
| 5,784,755 | A | 7/1998 | Karr et al. |
| 5,839,159 | A | 11/1998 | Karr et al. |
| 5,896,617 | A | 4/1999 | Kasen et al. |
| 5,901,408 | A | 5/1999 | Miller et al. |
| 6,145,159 | A | 11/2000 | Zahuranec et al. |
| 6,167,586 | B1 | 1/2001 | Reed, Jr. et al. |
| 6,325,864 | B1 | 12/2001 | Zahuranec et al. |
| 6,378,162 | B1 | 4/2002 | Zahuranec et al. |
| 6,725,498 | B2 | 4/2004 | Symensma et al. |

(Continued)

FOREIGN PATENT DOCUMENTS

WO 2006008451 1/2006

OTHER PUBLICATIONS

PCT/US2011/050224 International Search Report and Written Opinion dated Feb. 9, 2012 (12 pages).

(Continued)

*Primary Examiner* — David Redding
(74) *Attorney, Agent, or Firm* — Michael Best & Friedrich LLP

(57) ABSTRACT

An extractor cleaning machine includes a base having a distribution nozzle and a suction nozzle, a suction source in fluid communication with the suction nozzle, a recovery tank removably coupled to the base and having a recovery tank handle, an extractor handle pivotally coupled to the base, and a supply tank coupled to the extractor handle for pivotal movement with the extractor handle with respect to the base. At least a portion of the supply tank is positioned above and over the recovery tank in a direction normal to a surface to be cleaned when the extractor handle is in an upright storage position. The supply tank is in fluid communication with the distribution nozzle to supply cleaning fluid to the distribution nozzle. The extractor cleaning machine is liftable by the recovery tank handle when the extractor handle is in the upright storage position.

13 Claims, 9 Drawing Sheets

U.S. PATENT DOCUMENTS

| | | | |
|---|---|---|---|
| 6,735,818 | B2 | 5/2004 | Hamada et al. |
| 7,159,271 | B2 | 1/2007 | Sepke et al. |
| 7,373,690 | B2 | 5/2008 | Sepke et al. |
| 7,657,964 | B2 | 2/2010 | Parr et al. |
| 7,725,983 | B2 | 6/2010 | O'Neal |
| 7,814,612 | B2 | 10/2010 | Sepke et al. |
| 7,966,690 | B2 | 6/2011 | Lenkiewicz |
| 7,979,951 | B2 | 7/2011 | Lenkiewicz et al. |
| 7,979,955 | B2 | 7/2011 | Lenkiewicz et al. |
| 2006/0000051 | A1 | 1/2006 | Cipolla et al. |
| 2007/0226943 | A1 | 10/2007 | Lenkiewicz et al. |
| 2008/0189901 | A1 | 8/2008 | Jansen |
| 2009/0094782 | A1 | 4/2009 | Lenkiewicz |
| 2009/0094787 | A1 | 4/2009 | Sheddy et al. |
| 2009/0119868 | A1 | 5/2009 | Lenkiewicz et al. |

OTHER PUBLICATIONS

SteamVac Jr. Compact Spot Cleaner Advertisement, The Hoover Company, Available in 1996.

Chemstractor Soil Extractor Photographs, Available in 2001.

RECOVERY TANK FOR AN EXTRACTOR CLEANING MACHINE

CROSS-REFERENCE TO RELATED APPLICATIONS

This application claims priority to U.S. Provisional Patent Application No. 61/379,206, filed Sep. 1, 2010, the entire contents of which are incorporated herein by reference.

BACKGROUND

The present invention relates to extractor cleaning machines and, more particularly, to recovery tanks for extractor cleaning machines.

An extractor cleaning machine typically includes a recovery tank for recovering liquids and dirt drawn off of a surface that is being cleaned. Over the course of cleaning, the recovery tank fills to a capacity and needs to be drained. Some recovery tanks include handles to facilitate removing and carrying the recovery tanks apart from the extractor cleaning machines.

SUMMARY

In one embodiment, the invention provides an extractor cleaning machine including a base movable along a surface to be cleaned. The base includes a distribution nozzle and a suction nozzle. The extractor cleaning machine also includes a suction source in fluid communication with the suction nozzle. The suction source is operable to draw fluid and dirt from the surface through the suction nozzle. The extractor cleaning machine further includes a recovery tank removably coupled to the base. The recovery tank is in fluid communication with the suction source to receive and store the fluid and dirt drawn through the suction nozzle. The recovery tank includes a recovery tank handle. The extractor cleaning machine also includes an extractor handle pivotally coupled to the base to facilitate movement of the base along the surface. The extractor handle is pivotal with respect to the base from a substantially upright storage position to an inclined operating position. The extractor cleaning machine further includes a supply tank coupled to the extractor handle for pivotal movement with the extractor handle with respect to the base. At least a portion of the supply tank is positioned above and over the recovery tank in a direction normal to the surface to be cleaned when the extractor handle is in the upright storage position. The supply tank is in fluid communication with the distribution nozzle to supply cleaning fluid to the distribution nozzle. The extractor cleaning machine is liftable by the recovery tank handle when the extractor handle is in the upright storage position.

In another embodiment, the invention provides an extractor cleaning machine including a base having a front, a rear, a first side, and a second side. The base is movable along a surface to be cleaned and includes a distribution nozzle and a suction nozzle. The distribution and suction nozzles are located adjacent the front of the base. The extractor cleaning machine also includes an extractor handle pivotally coupled to the rear of the base to facilitate movement of the base along the surface and a supply tank coupled to one of the base and the extractor handle. The supply tank is in fluid communication with the distribution nozzle to supply cleaning fluid to the distribution nozzle. The extractor cleaning machine further includes a suction source in fluid communication with the suction nozzle. The suction source is operable to draw fluid and dirt from the surface through the suction nozzle. The extractor cleaning machine also includes a recovery tank removably coupled to the base. The recovery tank is in fluid communication with the suction source to receive and store the fluid and dirt drawn through the suction nozzle. The recovery tank includes a recovery tank handle. The extractor cleaning machine further includes a connector manually operable to removably couple the recovery tank to the base. The recovery tank handle is generally evenly spaced from the first and second sides of the base when the recovery tank is secured to the base so that the extractor cleaning machine is liftable by the recovery tank handle.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
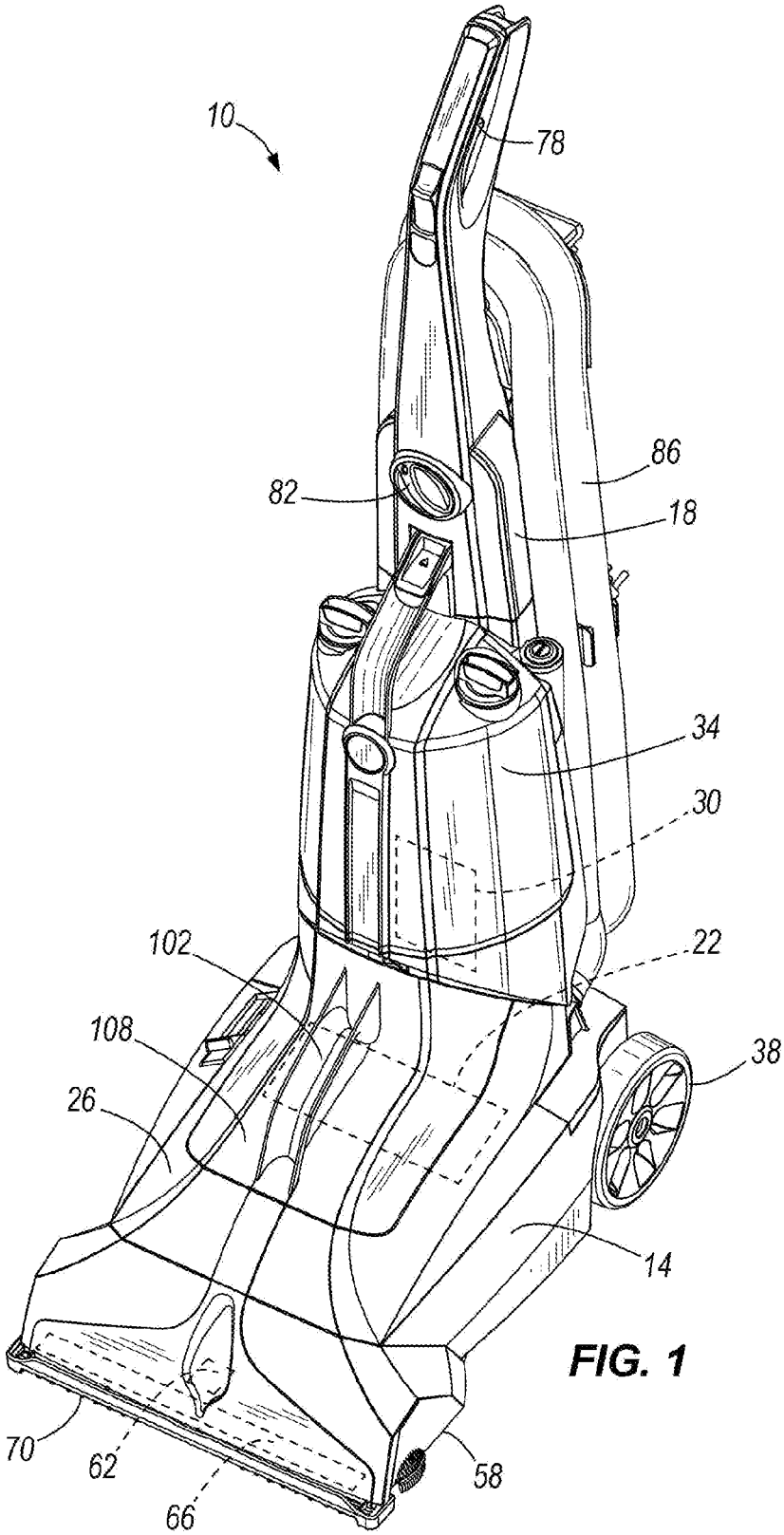
FIG. 1 is a perspective view of an extractor cleaning machine embodying the invention.

FIG. 1 illustrates an extractor cleaning machine 10 (hereinafter referred to simply as an "extractor"). In the illustrated embodiment, the extractor 10 is an upright extractor operable to clean a surface, such as, for example, a floor. In some embodiments, the extractor 10 may be adapted to clean a variety of surfaces, such as carpets, hardwood floors, tiles, or the like. The extractor 10 distributes or sprays a cleaning fluid (e.g., water, detergent, or a mixture of water and detergent) onto the surface to clean the surface. The extractor 10 then draws the cleaning fluid and any dirt off of the surface, leaving the surface relatively clean and dry.

The illustrated extractor 10 includes a base or foot 14, a handle 18 coupled to the foot 14, a suction source 22 supported by the foot 14, a recovery tank 26 coupled to the foot 14, a fluid distribution system 30 supported by the handle 18, and a supply tank assembly 34 coupled to the handle 18. In the illustrated embodiment, the suction source 22 is generally underneath the recovery tank 26. In other embodiments, the suction source 22 may be supported by the handle 18 or may be positioned elsewhere on the extractor 10.

The foot 14 is movable along the surface to be cleaned and supports the other components of the extractor 10. Two wheels 38 (only one of which is shown in FIG. 1) are coupled to the foot 14 to facilitate movement of the foot 14 along the surface. In the illustrated embodiment, the wheels 38 are idle wheels. In other embodiments, the wheels 38 may be driven wheels.

Figure 2:
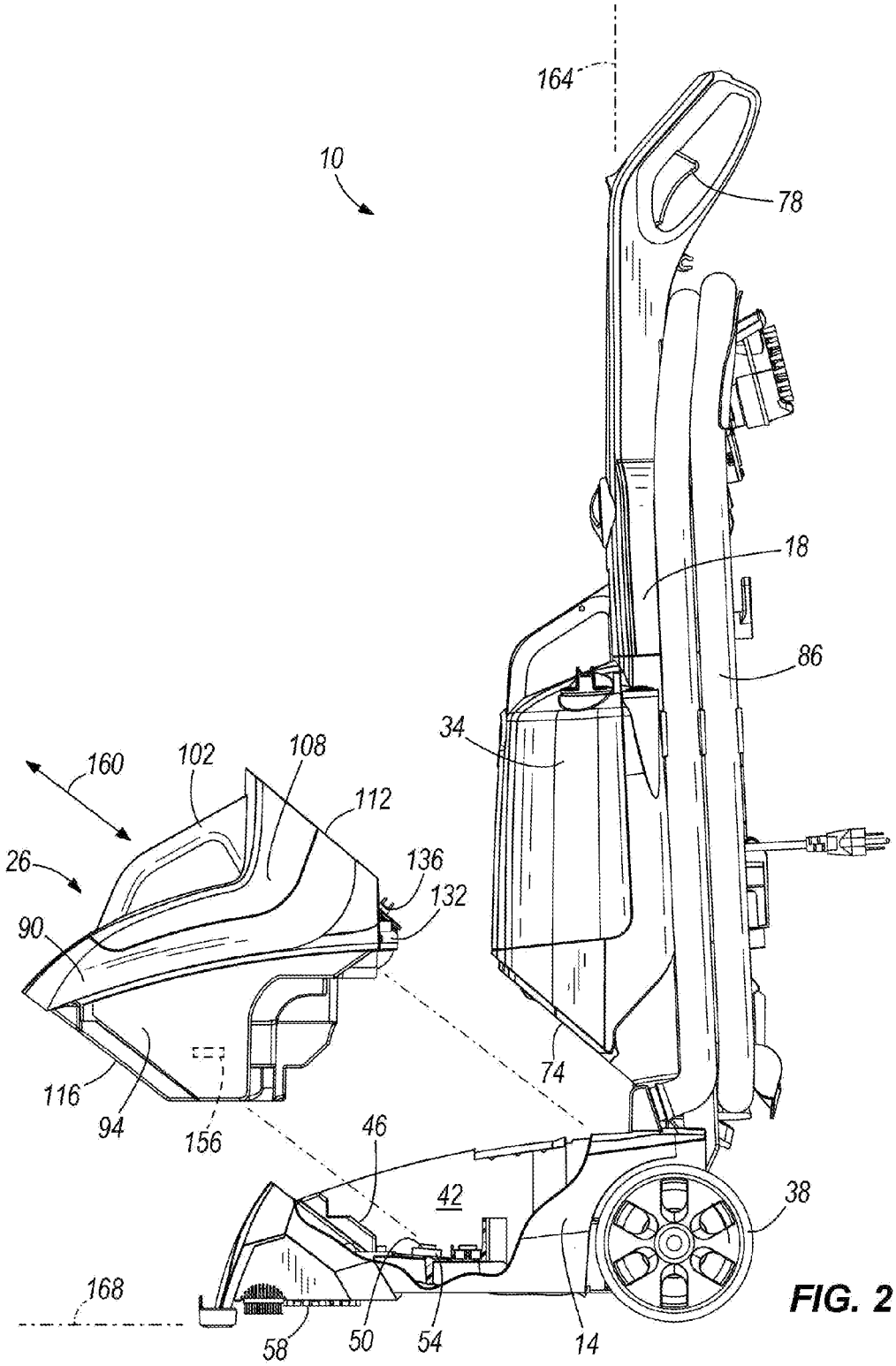
FIG. 2 is a cutaway side view of the extractor cleaning machine of FIG. 1 with a recovery tank of the extractor cleaning machine exploded.

As shown in FIG. 2, a cavity 42 is formed in the foot 14 to receive the recovery tank 26. The cavity 42 is configured with a plurality of internal surfaces 46. A magnet 50 is positioned within the cavity 42 and coupled to a first ferromagnetic plate 54.

Referring back to FIG. 1, the foot 14 further includes a distribution nozzle 62, a suction nozzle 66, and a brush assembly 70 adjacent a lower surface 58 of the foot. The distribution nozzle 62 directs cleaning fluid toward the surface to be cleaned. The suction nozzle 66 draws fluid and dirt from the surface back into the recovery tank 26 of the extractor 10. The brush assembly 70 is coupled to the lower surface 58 adjacent the distribution and suction nozzles 62 and 66 to scrub the surface. The brush assembly 70 also helps inhibit fluid from flowing beyond a periphery of the foot 14. In some embodiments, individual brushes of the brush assembly 70 may be electrically or pneumatically rotated to agitate and scrub the surface.

The suction source 22 is in fluid communication with the suction nozzle 66 to draw fluid and dirt from the surface through the suction nozzle 66. In one embodiment, the suction source 22 includes a fan that generates a vacuum to draw the fluid and dirt through the suction nozzle 66.

The fluid distribution system 30 is in fluid communication with the distribution nozzle 62 to draw cleaning fluid from the supply tank assembly 34 and distribute the fluid to the surface through the distribution nozzle 62. The illustrated distribution system 30 draws two separate cleaning fluids (e.g., water and detergent) from the supply tank assembly 34, mixes the fluids, and distributes the mixed cleaning fluid onto the surface. In some embodiments, the distribution system 30 may include a receptacle, a pump, a valve, and conduits connecting the supply tank assembly 34 to the distribution nozzle 62. In the illustrated embodiment, the distribution system 30 is supported by the handle 18 generally behind the supply tank assembly 34. In other embodiments, the distribution system 30 may be supported by the foot 14 or may be positioned elsewhere on the extractor 10. In some embodiments, the distribution system 30 may not include the pump such that the cleaning fluid is gravity-fed from the supply tank assembly 34 to the distribution nozzle 62.

The illustrated handle 18 is pivotally coupled to and extends from the foot 14. The handle 18 is pivotable or tiltable relative to the foot 14 from a generally vertical, or upright, storage position shown in FIG. 1 to an infinite number of non-vertical, or inclined, operating positions. Pivoting the handle 18 to an operating position facilitates moving the foot 14 along the surface. As shown in FIG. 2, the handle includes an inclined lower handle surface 74 that is positioned opposite the recovery tank 26 when the recovery tank is installed in the cavity 42.

As shown in FIGS. 1 and 2, the handle 18 supports a trigger 78 and a mode knob 82. The trigger 78 is actuatable to spray cleaning fluid from the supply tank assembly 34 through the distribution system 30 and the distribution nozzle 62 and onto the surface. The mode knob 82 adjusts the operating mode (i.e., wash, rinse, auto-rinse, etc.) of the extractor 10. The illustrated handle 18 also supports an accessory hose 86. The accessory hose 86 is connectable to a variety of hand-held tools to help clean smaller surfaces, such as, for example, steps.

Figure 3:
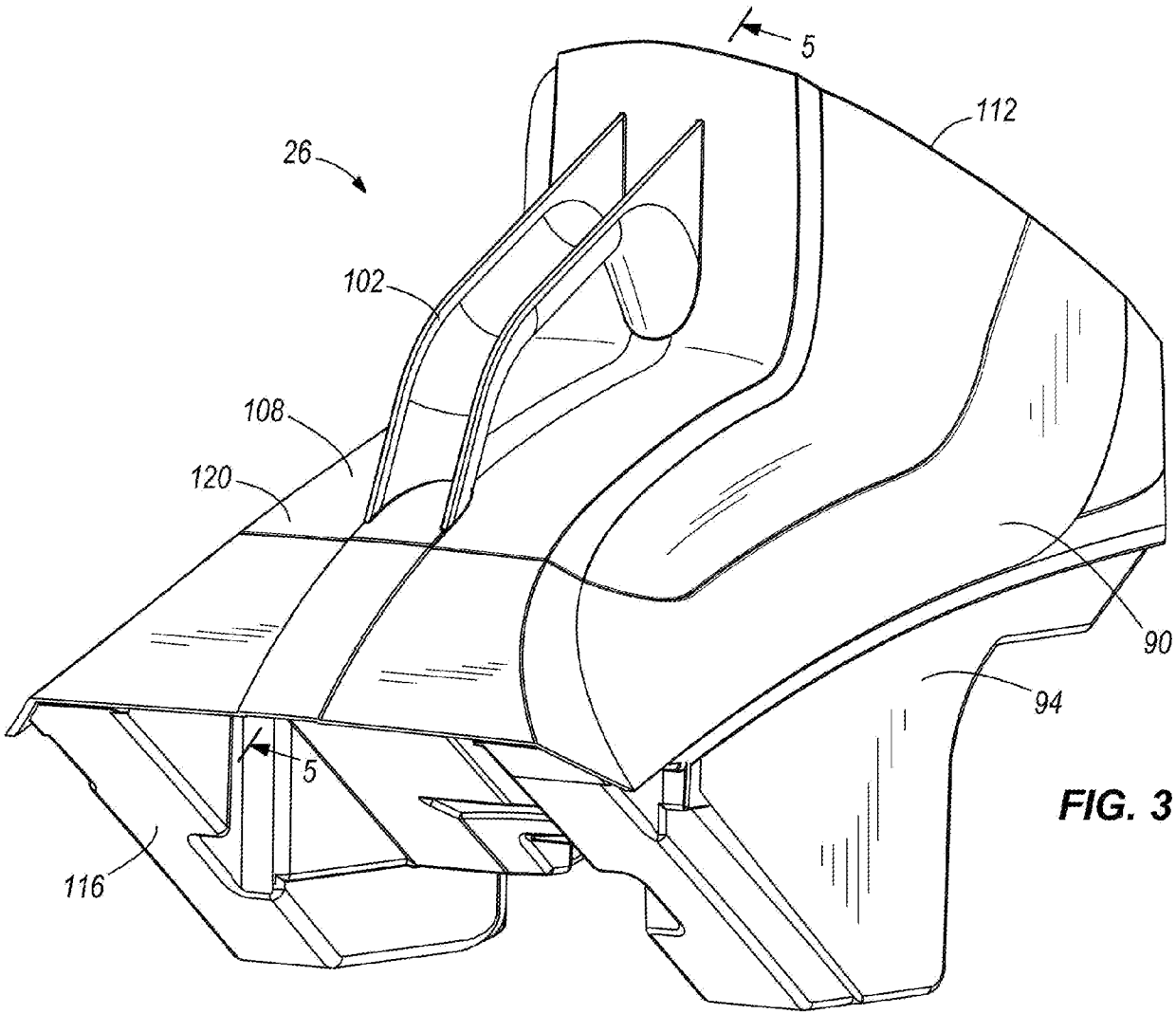
FIG. 3 is a front perspective view of the recovery tank of the extractor cleaning machine of FIG. 1.

As shown in FIGS. 2 and 3, the recovery tank 26 includes an upper portion 90 and a lower portion 94. The upper portion 90 and lower portion 94 define an internal volume 98 (FIG. 5) into which dirt and liquids are received (i.e., "recovered") via the suction nozzle 66 by an airflow generated by the suction source 22. A recovery tank handle 102 is integrally formed with a detachable recovery tank lid 108 as a single component. The handle 102 is positioned between an upper surface 112 and a lower surface 116 of the recovery tank 26. In other embodiments, the handle 102 may be separately formed from the recovery tank lid 108, or coupled to another part of the recovery tank 26. A front portion 120 of the recovery tank lid 108 includes hooks or tabs 122 (FIG. 5) that engage the recovery tank upper portion 90.

Figure 4:
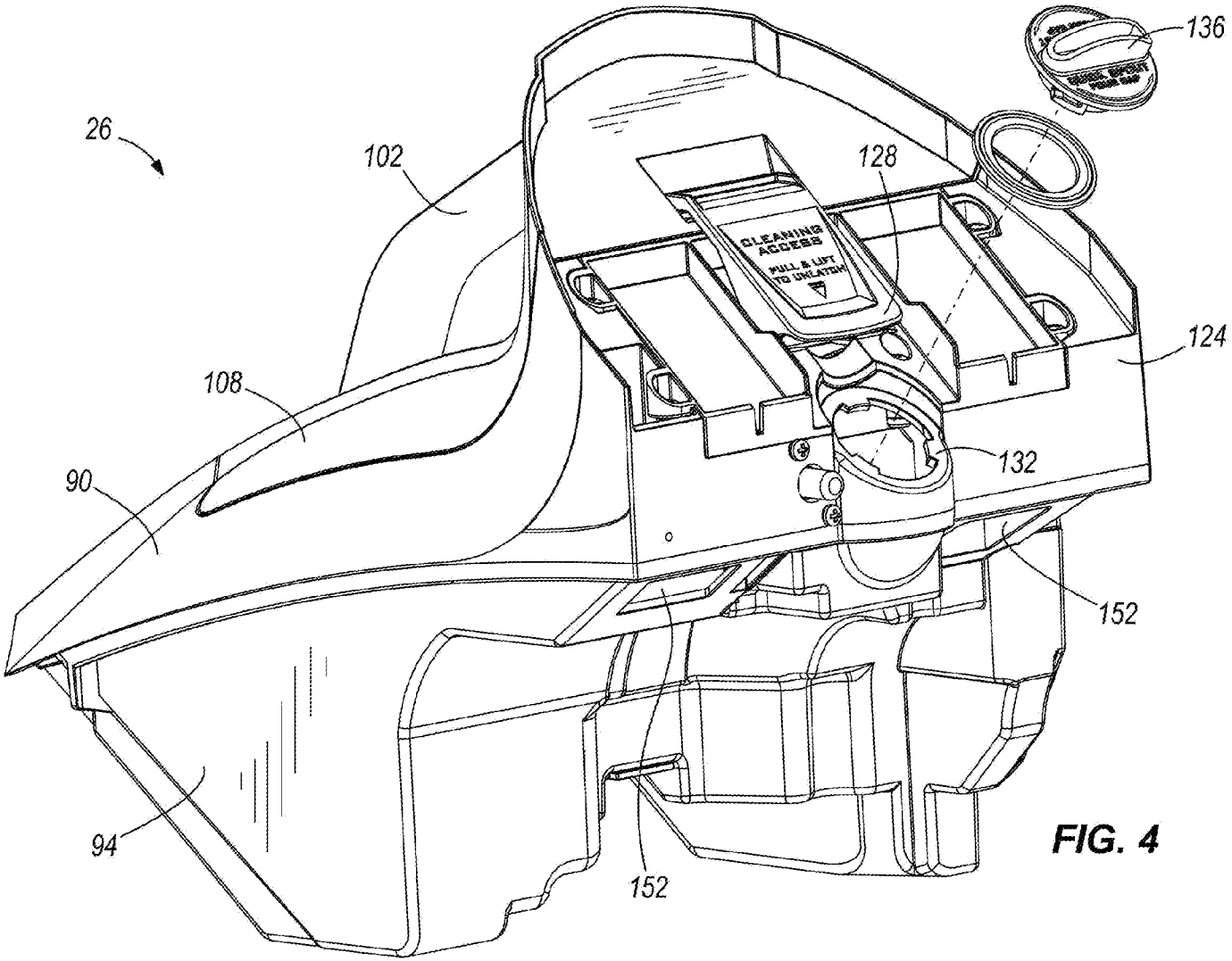
FIG. 4 is a rear partially exploded perspective view of the recovery tank of FIG. 3.

FIG. 4 is a rear perspective view of the recovery tank 26 that illustrates additional features on a rear portion 124 of the recovery tank 26, including a lid latch 128 and a pour spout 132. The lid latch 128 is provided to selectively couple the recovery tank lid 108 to the upper portion 90 of the recovery tank 26. In the illustrated embodiment, the lid latch 128 is an over-center type latch. In combination with the tabs 122 on the front portion 120, the lid latch 128 provides for selective detachment of the recovery tank lid 108 from the upper portion 90 in order to provide internal access to the internal volume 98 of the recovery tank 26 for cleaning and repair.

The rear portion 124 of the recovery tank 26 also includes the pour spout 132 and a pour spout cap 136. With the recovery tank 26 in an emptying position (i.e., separated from the extractor 10), the pour spout 132 allows the recovery tank 26 to be drained into a point of disposal such as a sink, tub, or other disposal basin. In the illustrated embodiment, the pour spout 132 is integrally formed as one with the upper portion 90 of the recovery tank 26. The pour spout 132 projects outwardly from the rear portion 124 of the recovery tank 26 and is configured to pour out the contents of the recovery tank 26 without substantial dripping or spillage. The position of the pour spout 132 at the rear portion 124 of the recovery tank 26 is substantially opposite the handle 102, such that a user may drain the recovery tank 26 with one hand. Furthermore, the pour spout cap 136 is provided to close off the pour spout 132 when the recovery tank 26 is installed in the cavity 62 and when carrying the recovery tank 26 to a point of disposal. The pour spout cap 136 may be threaded into the pour spout, or may be a frictional fit. In the illustrated embodiment, the pour spout cap 136 is a quick engagement type that requires less than 90 degrees rotation between engagement and disengagement.

As illustrated in FIG. 2, the recovery tank 26 is removably coupled to the cavity 42 formed in the foot 14. The recovery tank handle 102 facilitates removing and handling the tank 26 apart from the foot 14. When installed in the cavity 42, or in an operating position, the recovery tank 26 is in fluid communication with the suction source 22 and the suction nozzle 66 to receive and store the fluid and dirt drawn through the nozzle 66.

Figure 5:
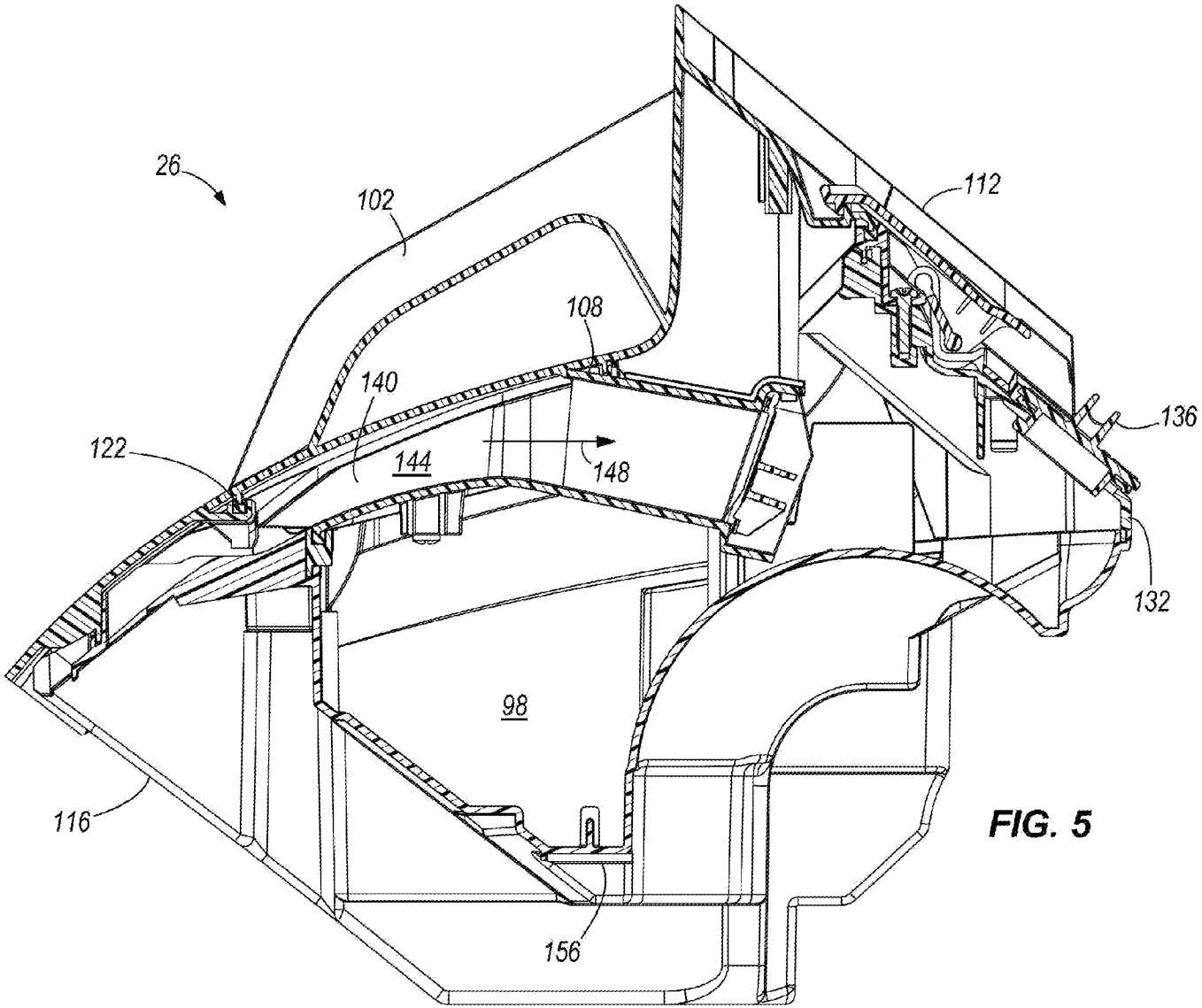
FIG. 5 is a cross-sectional view of the recovery tank taken along section line 5-5 in FIG. 3.

FIG. 5 is a cross-section illustrating the internal configuration of the recovery tank 26. The recovery tank lid 108 includes an air/water separator 140 that defines a conduit 144. A high velocity mixed (air and water) stream from the suction nozzle 66 enters the conduit 144. The conduit 144 increases in cross sectional area in a direction of flow 148. The increasing cross-sectional area slows down the mixed stream, allowing higher-density liquids to drop out and separate from the air stream. Drains are provided in the conduit 144 so that the liquids may collect in the recovery tank 26. Air discharged from the separator 140 has a substantially reduced moisture content, allowing for subsequent filtration and exhaust in other portions of the extractor 10. The conduit 144 exhausts through ports 152 (FIG. 4) at the rear portion 124 of the recovery tank.

As shown in FIGS. 2 and 5, a second ferromagnetic plate 156 is coupled to a bottom portion of the recovery tank 26. The ferromagnetic plates 54 and 156 are attracted to the magnet 50 to assist in providing consistent alignment between the recovery tank 26 and foot 14.

The magnet 50 and ferromagnetic plates 54 and 156 provide a more secure connection between the recovery tank 26 and the foot 14, but yet allow a user to remove the recovery tank 26 without having to operate a latch or the like. The more secure connection is desired so that the recovery tank 26 does not move or shift during operation of the extractor 10 or when the handle 18 is pivoted to the upright position. Movement of the recovery tank 26 during operation is undesirable because the recovery tank 26 is mechanically linked to other portions of the extractor 10. If the recovery tank 26 moves during operation, these connections may be compromised. In other embodiments, additional magnets may be provided, such as an opposing magnet on the recovery tank instead of a ferromagnetic plate.

FIG. 2 illustrates a feature of the extractor 10 that allows for removal and insertion of the recovery tank 26 from the cavity 42 of the foot 14 without tilting the handle 18 from the illustrated upright position. The recovery tank 26 may be conveniently removed and inserted along an insertion axis 160 between a vertical axis 164, defined by the upright handle 18, and a horizontal axis 168 defined by the foot (or a floor surface). As shown in FIG. 2, the lower surface 74 of the handle 18 is substantially parallel to the insertion axis 160 when the handle 18 is upright. Similarly, the internal surfaces 46 of the cavity 42 are substantially parallel to the insertion axis 160. The upper surface 112 and the lower surface 116 of the recovery tank 26 are also substantially parallel to the insertion axis 160 during removal, insertion and use. The configuration of the recovery tank 26, in combination with the configuration of the cavity 42, allows for convenient insertion and removal without repositioning the handle 18 relative to the foot 14.

Figure 6:
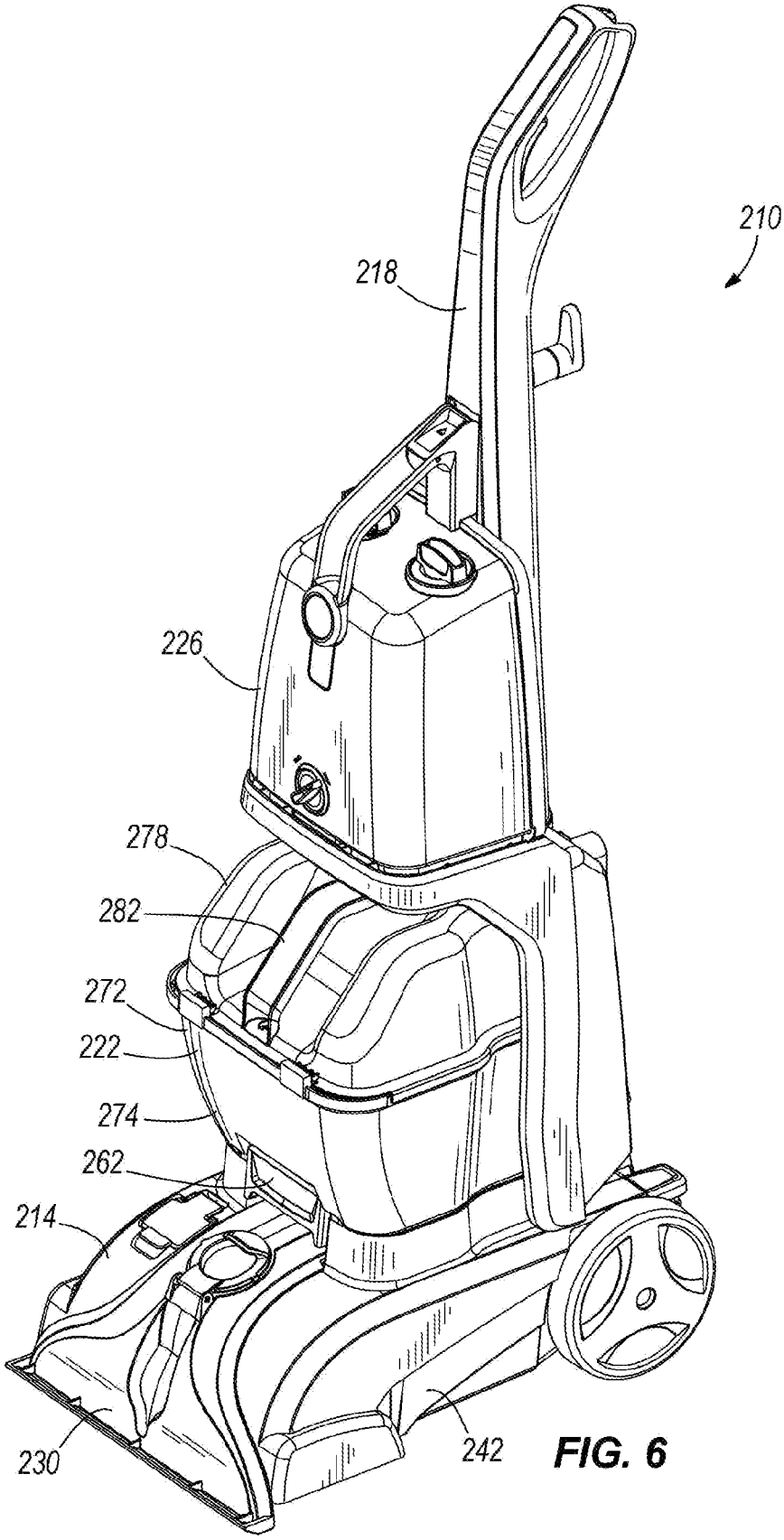
FIG. 6 is a perspective view of another extractor cleaning machine embodying the invention.
Figure 7:
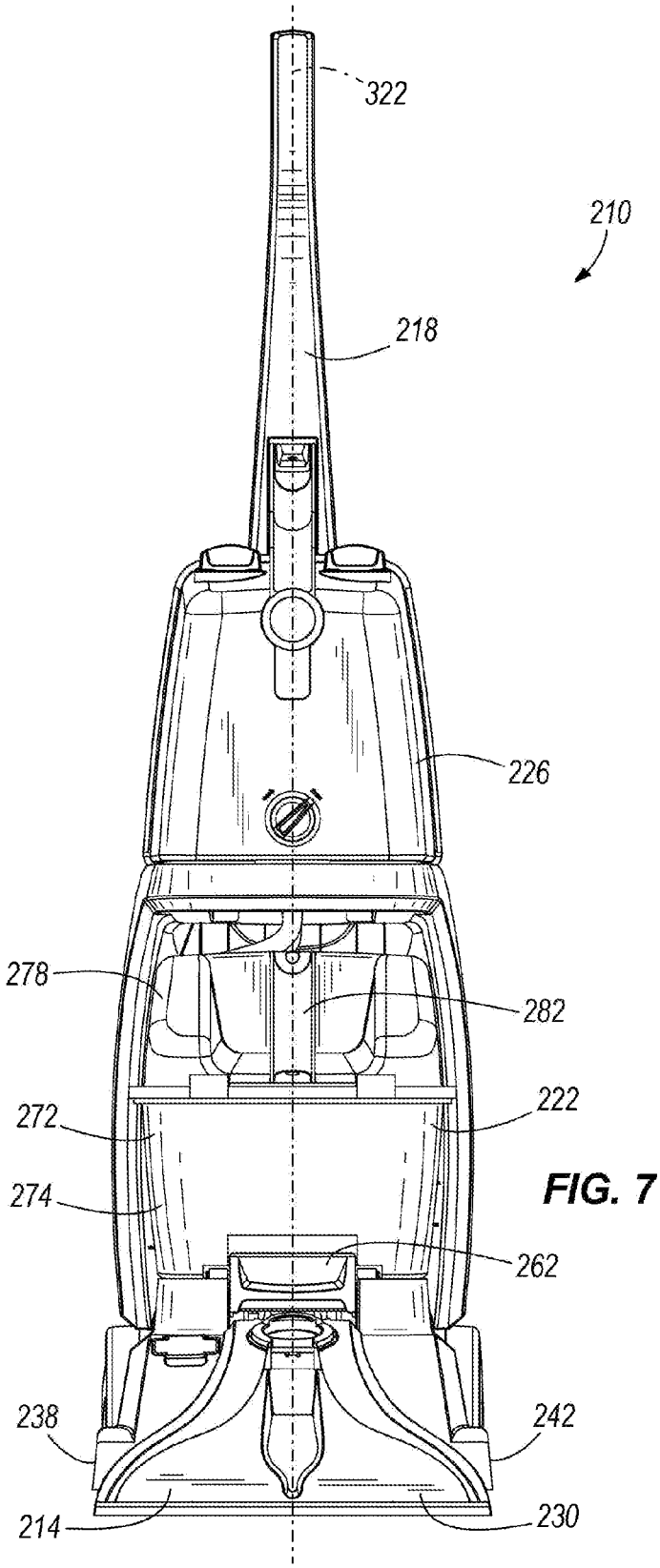
FIG. 7 is a front view of the extractor cleaning machine of FIG. 6.

FIGS. 6 and 7 illustrate another embodiment of an extractor cleaning machine 210 (an "extractor"). Similar to the extractor 10 discussed above, the illustrated extractor 210 is an upright extractor and includes a base 214, a handle 218 coupled to the base 214, a suction source supported by the base 214, a recovery tank 222 coupled to the base 214, a fluid distribution system supported by the handle 218, and a supply tank 226 coupled to the handle 218. Reference is hereby made to the description of the extractor 10 above for further discussion of the features and elements, as well as alternatives to the features and elements, of the extractor 210 not specifically disclosed below.

Figure 8:
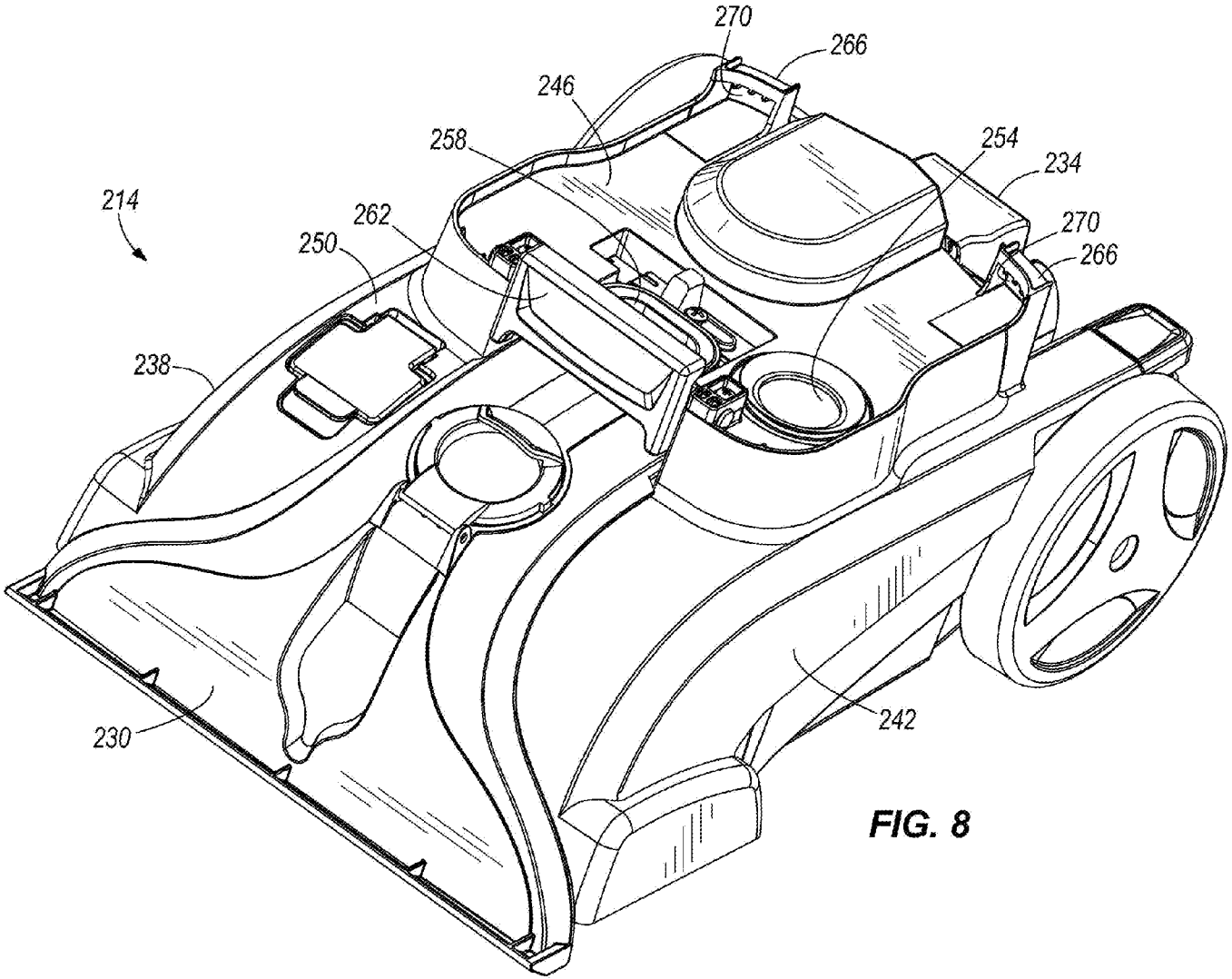
FIG. 8 is a top perspective view of a base of the extractor cleaning machine of FIG. 6.

As shown in FIG. 8, the base 214 includes a front 230, a rear 234, a first side 238, and a second side 242. A distribution nozzle and a suction nozzle (similar to the nozzles 62, 66 discussed above) are located adjacent the front 230 of the base 214. The handle 218 of the extractor 210 is pivotally coupled to the rear 234 of the base 214. The handle 218 is pivotable relative to the base 214 between a substantially upright storage position and an inclined operating position. As shown in FIGS. 6 and 7, the supply tank 226 is supported by the handle 218 for pivotal movement with the handle 218 with respect to the base 214. As best seen in FIG. 6, a portion of the supply tank 226 is positioned above and over the recovery tank 222 in a direction normal to the surface to be cleaned (e.g., in a vertical direction) when the handle 218 is in the upright storage position. At least a portion of the supply tank 226 is thereby positioned on top of the recovery tank 222 such that the supply tank 226 overlaps a portion of the recovery tank 222 in a direction parallel to the surface to be cleaned (e.g., in a horizontal direction) when the handle 218 is in the upright storage position. In the embodiment illustrated in FIG. 6, a substantial portion of the supply tank 226, almost the entire supply tank 226, is positioned above and over the recovery tank 222 when the handle 218 is in the upright storage position.

Referring back to FIG. 8, the base 214 includes a tank tray 246 formed on an upper surface 250 toward the rear 234 of the base 214. The tank tray 246 defines an area for receiving and supporting the recovery tank 222 (FIGS. 9 and 10) on the base 214. The tank tray 246 is generally shaped and sized to match the shape and size of a bottom surface of the recovery tank 222. A tank receptacle on the tank tray 246 includes two openings 254, 258 that are formed through the tank tray 246. The first opening 254 communicates with the suction source to create a vacuum within the recovery tank 222. The second opening 258 directs fluid and dirt drawn through the suction nozzle into the recovery tank 222.

The illustrated base 214 also includes a connector 262 coupled to a forward portion of the tank tray 246 and two posts 266 extending from a rearward portion of the tank tray 246. In the illustrated embodiment, the connector 262 is a latch and, more specifically, an over-center latch that is manually operable by a user to engage and disengage the recovery tank 222. In other embodiments, the connector 262 may include, for example, two latches positioned on opposing sides of the recovery tank 222, a pivotal latch that engages the tank 222, or a strong magnet. The latch 262 is pivotally coupled to the tank tray 246 and operable to engage a portion of the recovery tank 222. In other embodiments, the base 214 may include other suitable latching or connector mechanisms to engage the recovery tank 222. The posts 266 extend upwardly from the tank tray 246 and define recesses 270 that receive portions of the recovery tank 222. In some embodiments, the base 214 may include fewer or more posts 266 that define fewer or more recesses 270.

Figure 10:
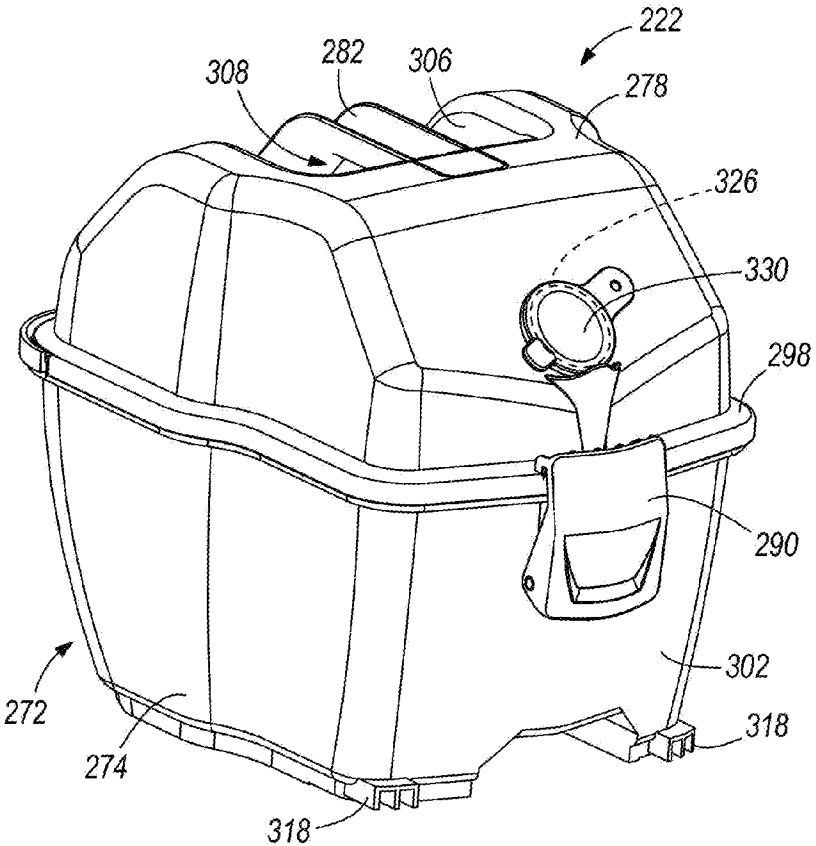
FIG. 10 is a rear perspective view of the recovery tank of the extractor cleaning machine of FIG. 6.
Figure 9:
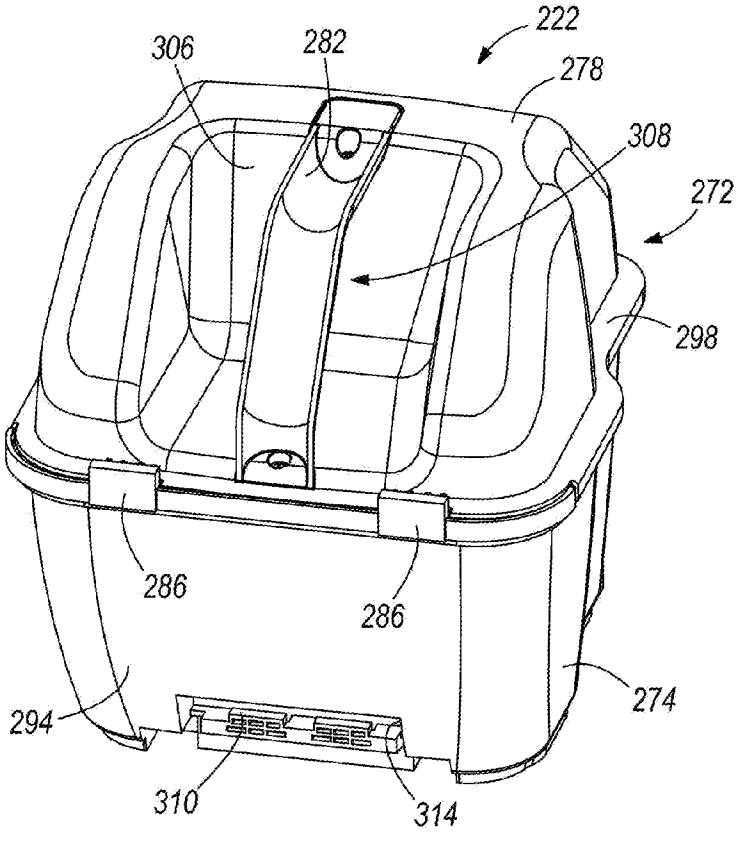
FIG. 9 is a front perspective view of a recovery tank of the extractor cleaning machine of FIG. 6.

Referring to FIGS. 9 and 10, the recovery tank 222 includes a tank portion 272 having a lower portion 274 and an upper portion 278, and a tank handle 282. In the illustrated embodiment, the lower and upper portions 274, 278 are two separate components that are releasably coupled together. In other embodiments, the tank portion 272 may be a unitary body with the lower portion 274 and the upper portion 278 formed together as a single piece. The upper portion 278 (i.e., cover or lid) is secured to the lower portion 274 (i.e., base) by two tabs 286 and a latch 290. The tabs 286 are formed on a first side 294 (e.g., front) of the recovery tank 222 and extend upwardly from the lower portion 274. The tabs 286 engage a rim 298 of the upper portion 278 to align the upper portion 278 on top of the lower portion 274. The latch 290 is pivotally coupled to the lower portion 274 on a second side 302 (e.g., rear) of the recovery tank 222 and also engages the rim 298 of the upper portion 278. The latch 290 selectively secures the upper portion 278 to lower portion 274 to inhibit separation of the portions 274, 278. Similar to the latch 262 discussed above, the illustrated latch 290 is an over-center latch, but may alternatively be another suitable latching mechanism.

In the illustrated embodiment, the tank handle 282 is coupled to and extends from the upper portion 278 of the tank portion 272. In other embodiments, the tank handle 282 may extend from the lower portion 274 of the tank portion 272 or may extend from both the lower and upper portions 274, 278 of the tank portion 272. The illustrated handle 282 is positioned on the first side 294 of the recovery tank 222 within a recessed surface 306 in the upper portion 278. The recessed surface 306 defines an aperture 308 between the tank portion 272 and the tank handle 282 that facilitates accessing and grasping the tank handle 282. The handle 282 is oriented generally perpendicular to the first and second sides 294, 302 of the recovery tank 222 and follows the contour of the upper portion 278. In the illustrated embodiment, the tank handle 282 is fixed to the upper portion 278 of the tank portion 272 such that the handle 282 is stationary (e.g., does not pivot, rotate, or slide) relative to the tank portion 272. In other embodiments, the handle 282 may be integrally formed with the tank portion 272. In still other embodiments, the handle 282 may be pivotable, rotatable, slidable, or otherwise movable relative to the tank portion 272. The tank handle 282 facilitates removing and handling the recovery tank 222 apart from the base 214 when the recovery tank 222 is not secured to the base 214.

As shown in FIG. 9, the recovery tank 222 includes a flange 310 formed on the first side 294 of the lower portion 274 of the tank portion 272. The illustrated flange 310 is positioned within a recess 314 adjacent the bottom surface of the tank 222 and is engageable by the latch 262 (FIG. 8) of the base 214 when the recovery tank 222 is positioned on the tank tray 246. As shown in FIGS. 6 and 7, the latch 262 fits within the recess 314 of the recovery tank 222 when the latch 262 engages the flange 310 to reduce the possibility of unintentionally actuating the latch 262. The latch 262 and the flange 310 create a relatively strong locking force between the recovery tank 222 and the base 214 to secure the recovery tank 222 to the base 214. In other embodiments, the relative positions of the latch 262 and the flange 310 may be reversed (i.e., the latch 262 may be coupled to and supported by the recovery tank 222, and the flange 310 may be formed on the base 214).

As shown in FIG. 10, the recovery tank 222 also includes two feet 318 extending outwardly from the second side 302 of the lower portion 274 of the tank portion 272. The feet 318 are positioned adjacent the bottom surface of the tank 222 and configured to extend into the recesses 270 (FIG. 8) in the base 214 when the recovery tank 222 is positioned on the tank tray 246. Similar to the latch 262 and the flange 310, the recesses 270 and the feet 318 help secure the recovery tank 222 to the base 214. The feet 318 increase the strength of the engagement at the interface between the recovery tank 222 and the base 214. In other embodiments, the relative positions of the recesses 270 and the feet 318 may be reversed (i.e., the recesses 270 may be formed in the recovery tank 222, and the feet 318 may extend from the base 214). In still other embodiments, the recovery tank 222 may include other types of projections that extend into recesses or slots in the base 214 and/or the projections may be positioned elsewhere on the tank 222. In some embodiments, the extractor 210 may include multiple connectors such that the projections and recesses may be omitted.

Referring back to FIGS. 6 and 7, when the recovery tank 222 is connected to the extractor 210, the feet 318 extend into the recesses 270 in the base 214 and the latch 262 engages the flange 310 to secure the recovery tank 222 to the extractor 210. In this position, the recovery tank 222 can receive and store fluid and dirt drawn through the suction nozzle via the second opening 258 (FIG. 8) in the tank tray 246 during operation of the extractor 210. In addition, the tank handle 282 can be used to lift the entire extractor 210. When the recovery tank 222 is connected to the extractor 210, the tank handle 282 remains exposed and accessible, even when the handle 218 of the extractor 210 is in the upright storage position. A user can thereby grasp the handle 282 to manually lift and carry the extractor 210. The latch 262 and the feet 318 provide a strong enough engagement between the recovery tank 222 and the base 214 to inhibit separation of the tank 222 from the base 214 when the extractor 210 is lifted by the tank handle 282.

The illustrated tank handle 282 is generally evenly spaced from and extends parallel to the first and second sides 238, 242 of the base 214 when the recovery tank 222 is connected to the base 214. The upright handle 218 of the extractor 210 defines a central longitudinal axis 322 that divides the extractor 210 in half. When the handle 218 is in the upright position and the extractor 210 is viewed from the front 230 (as illustrated in FIG. 7), the tank handle 282 generally overlays (i.e., lies along) the central longitudinal axis 322. As such, the weight of the extractor 210 is generally evenly distributed on each side of the tank handle 282. The extractor 210 is thereby balanced such that a user can lift the extractor 210 by the tank handle 282 without the extractor 210 tending to tip toward either side 238, 242 of the base 214.

As shown in FIG. 10, in the illustrated embodiment, the latch 290 connecting the upper portion 278 of the tank portion 272 to the lower portion 274 of the tank portion 272 is positioned on the second side 302 of the recovery tank 222 to hide and cover the latch 290 when the tank 222 is connected to the extractor 210. That is, as shown in FIGS. 6 and 7, the latch 290 is covered by the handle 218 of the extractor 210 such that the latch 290 cannot be easily accessed and disengaged to separate the upper portion 278 from the lower portion 274 of the tank portion 272 while the recovery tank 222 is supported on the base 214. The upper portion 278 thereby cannot be accidentally separated from the lower portion 274 when lifting the extractor 210 by the tank handle 282.

Referring back to FIG. 10, the recovery tank 222 also includes an opening 326 formed through the second side 302 of the upper portion 278. The opening 326 is covered by a cap 330 that blocks the opening 326. The cap 330 is removable from the opening 326 to allow access through the opening 326. When uncovered, the opening 326 is used for emptying fluid and dirt stored in the recovery tank 222. The illustrated opening 326 is positioned on a different side of the recovery tank 222 than the tank handle 282 such that a user may grasp the handle 282 to tip the recovery tank 222 to pour the fluid and dirt out of the tank 222 through the opening 326.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. An extractor cleaning machine comprising:

a base movable along a surface to be cleaned, the base including a distribution nozzle and a suction nozzle;

a suction source in fluid communication with the suction nozzle, the suction source operable to draw fluid and dirt from the surface through the suction nozzle;

a recovery tank removably coupled to the base, the recovery tank in fluid communication with the suction source to receive and store the fluid and dirt drawn through the suction nozzle, the recovery tank including a recovery tank handle;

an extractor handle pivotally coupled to the base to facilitate movement of the base along the surface, the extractor handle pivotal with respect to the base from a substantially upright storage position to an inclined operating position; and a supply tank coupled to the extractor handle for pivotal movement with the extractor handle with respect to the base, at least a portion of the supply tank is positioned above and over the recovery tank in a direction normal to the surface to be cleaned when the extractor handle is in the upright storage position, and the supply tank is in fluid communication with the distribution nozzle to supply cleaning fluid to the distribution nozzle, wherein the extractor cleaning machine is liftable by the recovery tank handle when the extractor handle is in the upright storage position.

2. The extractor cleaning machine of claim 1, wherein the recovery tank includes a tank portion, and wherein the recovery tank handle extends from the tank portion to define an aperture between the tank portion and the recovery tank handle to allow the recovery tank handle to be manually grasped.

3. The extractor cleaning machine of claim 2, wherein the tank portion includes a recovery tank base and a recovery tank cover removably coupled to the recovery tank base, wherein the recovery tank handle extends from the recovery tank cover.

4. The extractor cleaning machine of claim 3, wherein the recovery tank includes an opening for emptying the fluid and dirt stored in the recovery tank, wherein the recovery tank handle is positioned on a first side of the recovery tank and the opening is positioned on a second side of the recovery tank to allow the fluid and dirt to be poured through the opening while grasping the recovery tank handle.

5. The extractor cleaning machine of claim 4, wherein the opening extends through the recovery tank cover.

6. The extractor cleaning machine of claim 2, wherein the recovery tank handle is stationary relative to the tank portion.

7. The extractor of cleaning machine of claim 1, wherein the base includes a front and a rear, wherein the distribution and suction nozzles are located adjacent the front of the base and the extractor handle is pivotally coupled to the rear of the base, wherein the extractor handle defines a central longitudinal axis, and wherein the recovery tank handle generally overlays the central longitudinal axis of the extractor handle when viewed from the front.

8. The extractor cleaning machine of claim 1, further comprising a latch that removably couples the recovery tank to the base.

9. The extractor cleaning machine of claim 8, wherein the latch is coupled to the base and the base includes a recess, wherein the recovery tank includes a flange and a foot, wherein the foot extends into the recess and the latch engages the flange to secure the recovery tank to the base.

10. The extractor cleaning machine of claim 9, wherein the latch and the flange secure a first side of the recovery tank to the base, and wherein the foot and the recess secure a second side of the recovery tank that is substantially opposite the first side to the base.

11. The extractor cleaning machine of claim 8, wherein the latch is a first latch, and wherein the recovery tank includes a recovery tank base and a recovery tank cover removably coupled to the recovery tank base by a second latch.

12. The extractor cleaning machine of claim 1, wherein the recovery tank handle facilitates removing and handling the recovery tank apart from the base.

13. The extractor cleaning machine of claim 12, wherein the recovery tank includes an opening for emptying the fluid and dirt stored in the recovery tank, wherein the recovery tank handle allows the fluid and dirt to be poured through the opening while grasping the recovery tank handle.

* * * * *